United States Patent [19]

Chiappetta et al.

[11] Patent Number: 4,470,249

[45] Date of Patent: Sep. 11, 1984

[54] MULTI-LAYER, CONTRAHELICALLY STRANDED WIRE ROPE

[75] Inventors: Ferdinand Chiappetta; Neville H. Simpson; John H. Simpson, all of Kenosha, Wis.

[73] Assignee: AMSTED Industries Incorporated, Chicago, Ill.

[21] Appl. No.: 467,969

[22] Filed: Feb. 18, 1983

[51] Int. Cl.[3] ..... D07B 1/06

[52] U.S. Cl. ..... 57/213; 57/217

[58] Field of Search ..... 57/200, 210, 212–223, 57/230, 232

[56] References Cited

U.S. PATENT DOCUMENTS

| | | | |
|---|---|---|---|
| 3,306,022 | 2/1967 | Stevens | 57/214 |
| 3,824,777 | 7/1974 | Riggs | 57/214 |
| 4,158,946 | 6/1979 | Bourgois | 57/213 |
| 4,299,082 | 11/1981 | Tarantola | 57/9 |
| 4,365,467 | 12/1982 | Pellow | 57/214 |

*Primary Examiner*—Donald Watkins

*Attorney, Agent, or Firm*—Fred P. Kostka

[57] ABSTRACT

A wire rope comprising an outer rope layer and an inner rope layer of wire strands is provided. The inner rope layer itself is comprised of multiple layers, usually in a parallel laid, coreless arrangement. The inner and outer rope layers are contrahelically laid and are usually lubricated. A thermoplastic or elastomer can be utilized to encapsulate the lubricant within the inner rope layer or within both the inner and outer rope layers.

15 Claims, 6 Drawing Figures

MULTI-LAYER, CONTRAHELICALLY STRANDED WIRE ROPE

BACKGROUND OF THE INVENTION

The present invention relates generally to wire rope, and more specifically to a multi-layer, contrahelically stranded wire rope, which may be plastic impregnated.

Multi-layer contrahelically laid wire ropes are known to exhibit excellent resistance to axial rotation, especially when the inner rope itself is multi-layer and parallel lay. However, when such wire ropes have a central core strand within the inner rope the wire rope exhibits certain undesired characteristics. These characteristics include the tendency of the core strand to assume a greater portion of the load distribution, often becoming the point of initial rope deterioration and the tendency to stiffen the inner parallel lay rope which in turn produces a sliding motion between the outer and inner ropes. Such sliding causes intermediate rope abrasion, expansion or popping of the core strand or of the inner rope and bird caging or expansion of the outer rope. Further, the radial elasticity of the inner rope is reduced. All these undesirable results of the central core strand tend to produce increased inner rope deterioration which is especially undesirable as such weakening of the entire rope takes place before any deterioration of the outer rope is detectable.

Accordingly, it is an object of this invention to provide a high strength, torque-equalized wire rope.

SUMMARY OF THE INVENTION

The present invention provides a multi-layer, contrahelically laid, rotation resistant wire rope. Generally, the rope comprises contrahelically laid inner and outer ropes producing a rope having improved strength, flexibility and stability. By contrahelically laid is meant that the inner and outer rope layers are of opposite lay direction.

In particular, the present invention provides a wire rope comprising at least six outer strands, each of said outer strands having a plurality of component wires, and a plurality of contrahelically laid inner rope strands, said inner rope strands being of parallel lay and comprising at least a central layer and an adjacent outer layer, said central layer of said inner rope strands forming a space at their axial center, each of said inner rope strands having a plurality of component wires.

In preferred embodiments of the present invention, a viscous lubricant such as petrolatum or an asphaltic based lubricant is applied to the rope strands. Then either the inner rope or the entire wire rope is impregnated with a load bearing thermoplastic such as polypropylene or an elastomer having similar properties. Such impregnation results in the introduction of the thermoplastic or elastomer into the interstices between the inner rope strands and the outer rope strands and between the outer rope strands themselves to entrap the lubricant in the inner rope and in the outer rope strands. Further, such encapsulation adds stability and load sharing properties to the rope by forming a matrix to support and lock the rope strands in position relative to each other.

Another preferred property of the wire rope of the present invention is that the total area of the inner rope strands and the total area of the outer rope strands are approximately equal. This adds to the load sharing stability and torque-equalization of the rope.

The configurations of the inner rope strands and of the outer rope strands can be any of various known configurations, with various total numbers of individual wires. The inner parallel lay rope can be of a Warrington, Seale or Filler Wire configuration, or combinations of these. Specific embodiments of these configurations will be shown and described in the detailed description of the present invention.

One preferred embodiment of the present invention comprises a wire rope having an outer rope layer of right regular lay and two layers of inner rope strands, the central layer of which is left regular lay and the adjacent outer layer of which is left lang lay. Another preferred embodiment of the present invention includes a rope having an outer rope layer of left regular lay, an inner rope having an outer layer of right lang lay and a central layer of right regular lay. Nesting and line contact are provided between the outer surface of the inner layer and the inner surface of the outer layer of the inner rope. Such an arrangement results in reduced friction and abrasion between the two layers of the inner rope.

DETAILED DESCRIPTION

Figure 1:
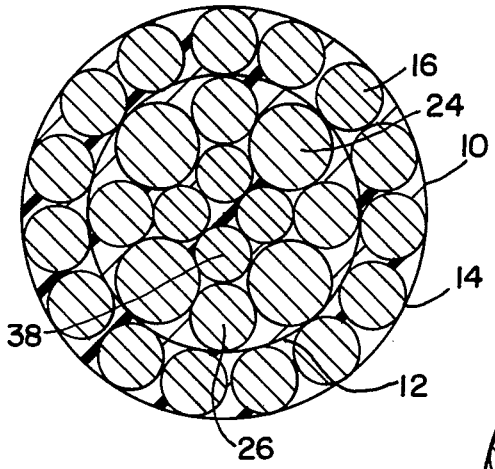
FIG. 1 is a cross-sectional view of one embodiment of the present invention.
Figure 2:
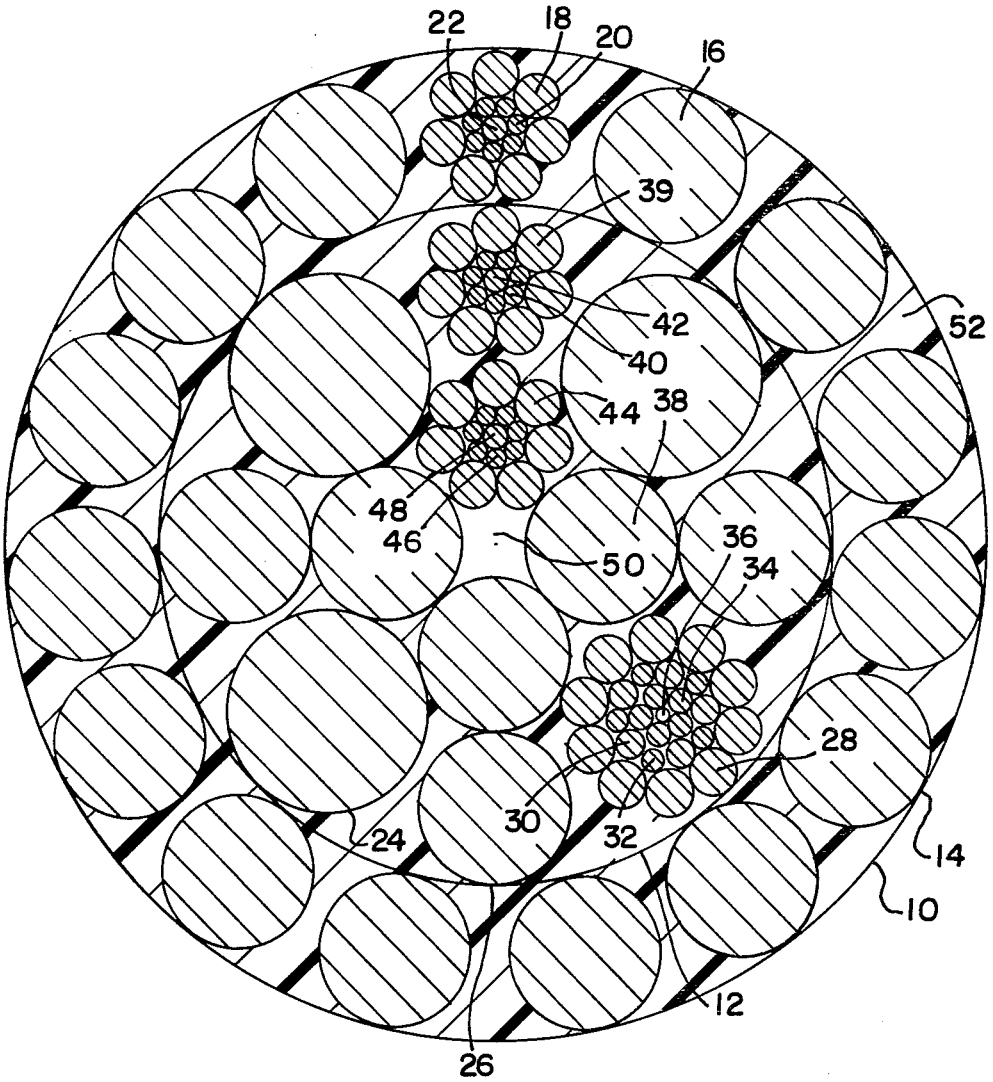
FIG. 2 is a detailed cross-section of the embodiment of the present invention shown in FIG. 1.

Referring to FIGS. 1 and 2, a wire rope is shown generally at 10. Rope 10 is comprised of an inner rope 12 and an outer rope 14. Outer rope 14 is comprised of fifteen individual strands 16, each of which is itself comprised of individual wires. Such outer strand 16 individual wires include outer wires 18, inner wires 20 and core wire 22. Inner rope 12 is comprised of eight outer layer strands 24, 26 and four inner layer strands 38. The outer layer of inner rope 12 comprises alternating four large diameter strands 24 and four smaller diameter strands 26. Each large diameter strand 24 is comprised of outer wires 28, alternating large and small diameter intermediate wires 30 and 32, respectively, and inner wires 34 with core wire 36. Each smaller diameter strand 26 is comprised of outer wires 39, inner wires 40 and core wire 42. The four inner layer strands 38 of inner rope 12 are each comprised of outer wires 44, inner wires 46 and core wire 48. Inner layer strands 38 form a coreless space 50 at the center of wire rope 10.

Figure 6:
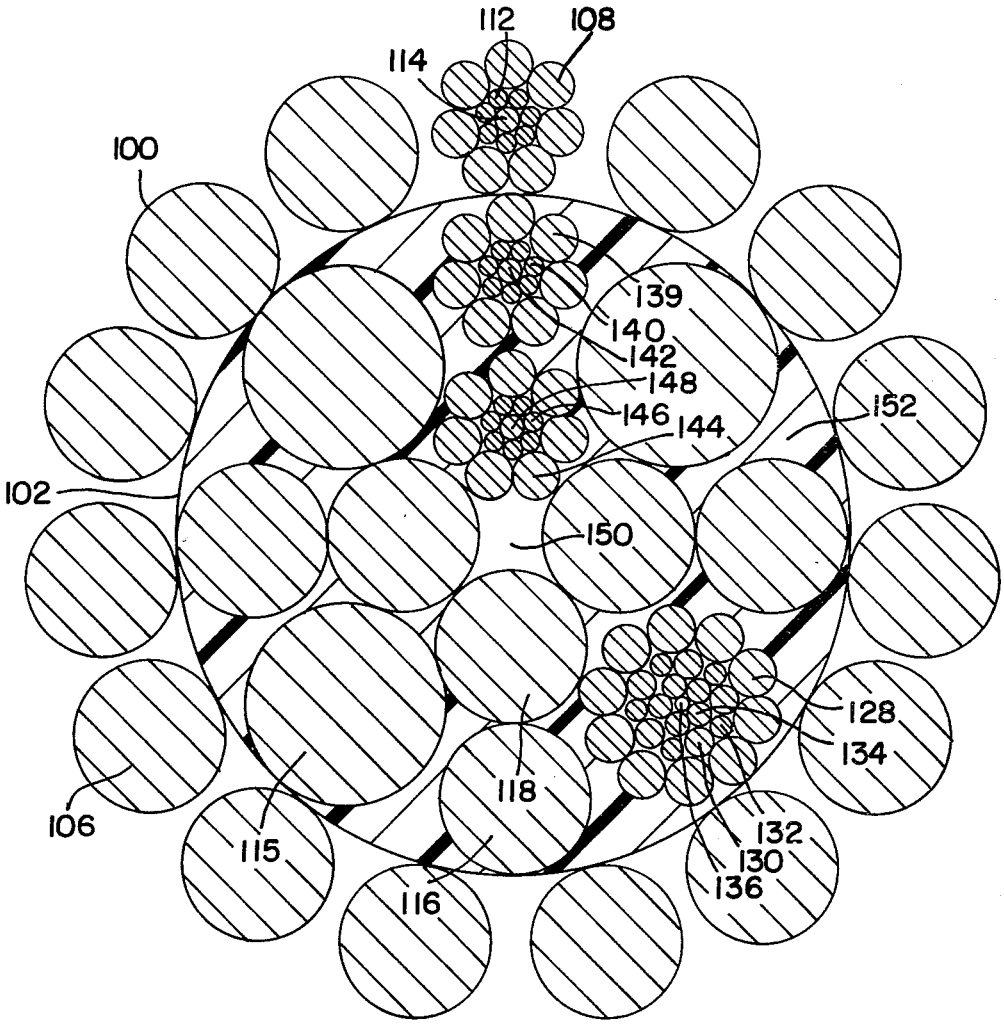
FIG. 6 is a detailed cross section of another embodiment of the present invention.

A thermoplastic or elastomer 52 extends from inner layer strands 38 to the outer periphery of outer strands 16. However, it is considered part of the present invention to have thermoplastic 52 extend outwardly only to the outer periphery of inner rope 12 as shown in FIG. 6 and described below. In either case, thermoplastic 52 acts to maintain a lubricant around inner rope strands 24, 26 and 38, and to keep such strands in prearranged relation to each other. Where thermoplastic 52 extends to the outer periphery of outer strands 16, it acts to keep a lubricant also within outer strands 16 and to keep such outer strands 16 in a prearranged relation to inner rope 12.

In the embodiment of the present invention shown in FIGS. 1 and 2, outer strands 16 are laid in a right-hand clockwise direction, whereas the component wires 18 and 20 are laid in a left-hand counterclockwise direction. Outer strands 16 are shown in a fifteen strand Seale configuration.

Inner rope 12 comprises two layers in parallel lay, of coreless Warrington configuration. Large and smaller diameter strands 24 and 26 are laid alternately left lang lay. Wires 39 and 40 of smaller strands 26 and wires 28, 30, 32 and 34 of large strands 24 are laid in a left hand counterclockwise direction. Large strands 24 are shown in a twenty-six wire Warrington-Seale configuration, and smaller strands 26 are shown in a fifteen wire Seale configuration.

Inner layer strands 38 are of left regular lay, with the strands 38 laid in a left hand counterclockwise direction and wires 44 and 46 laid in a right hand clockwise direction. Each strand 38 is shown in a fifteen wire Seale configuration.

In FIGS. 1 and 2, the diameter and wire configuration of strands 38, 26 and 16 are all identical. Further, the outer wires 44, 39, 18 and 28 of strands 38, 26, 16 and 24 are all of identical diameter.

Figure 3:
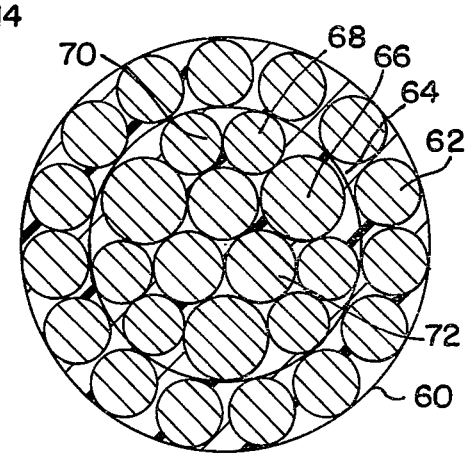
FIG. 3 is a cross-sectional view of another embodiment of the present invention.

Another embodiment of the present invention is shown in FIG. 3. Wire rope 60 having an outer rope comprising fifteen strands 62 is provided, along with inner rope 64 comprising nine outer layer strands 66, 68 and 70 and three inner larger diameter strands 72. Outer rope strands 62 are of identical diameter. Inner rope strands 66 are of a larger diameter than identical diameter strands 68 and 70, which are positioned side by side in three groups of two alternating with three larger strands 66. Inner rope inner layer strands 72 are of an identical diameter, and form a coreless wire rope. Because of the arrangement of inner rope outer layers strands 66, 68 and 70, wire rope 60 can be said to be of a modified Warrington configuration. It is to be understood that all strands of rope 60 could be lubricated, and that a thermoplastic or elastomer could extend to the periphery of inner rope 64 or to the periphery of outer strands 62, as desired. It is further understood that all strands of rope 60 are comprised of a plurality of individual wires.

Figure 4:
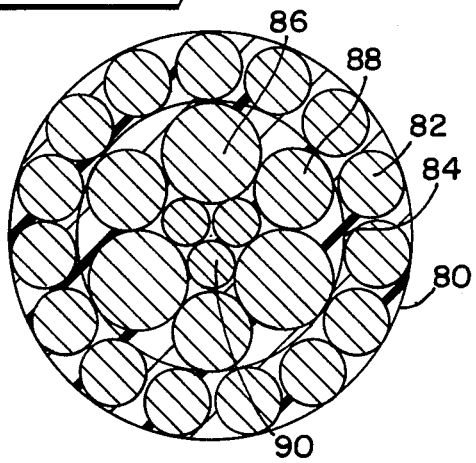
FIG. 4 is a cross-sectional view of another embodiment of the present invention.

Another embodiment of the present invention is shown in FIG. 4. Wire rope 80 having an outer rope comprising fifteen strands 82 is provided, along with inner rope 84 comprising six outer layer strands 86 and 88 and three inner layer strands 90. Outer rope strands 82 are of identical diameter. Inner rope outer strands 86 are of a larger diameter than inner rope outer strands 88, which alternate three each. Inner rope inner layer strands 90 are three in number and of identical diameter, and form a coreless wire rope. Because of the arrangement of inner rope outer layer strands 86 and 88, wire rope 80 can be said to be of a Warrington arrangement. It is to be understood that all strands of rope 80 could be lubricated, and that a thermoplastic or elastomer could extend to the periphery of inner rope 84 or to the periphery of outer strands 82, as desired. It is further understood that all strands of rope 80 are comprised of a plurality of individual wires.

Figure 5:
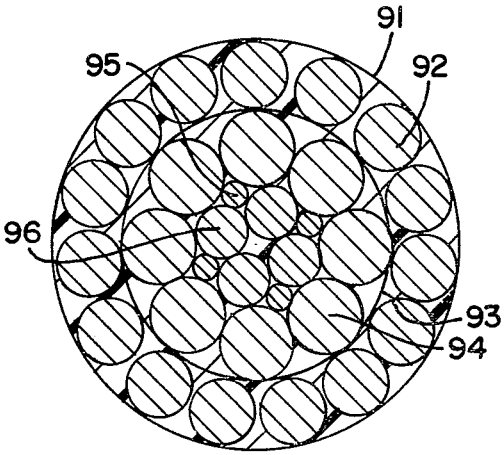
FIG. 5 is a cross-sectional view of another embodiment of the present invention.

Another embodiment of the present invention is shown in FIG. 5. Wire rope 91 having an outer rope comprising fifteen strands 92 is provided, along with inner rope 93 comprising outer layer strands 94, inner layer strands 96 and filler wire strands 95. Outer rope strands 92 are of identical diameter. Inner rope outer strands 94 are of identical diameter and are positioned in an eight strand arrangement. Inner rope inner layer strands 96 are of an identical diameter in a four strand arrangement, and form a coreless wire rope. Filler wire strands 95 are of a smaller diameter than inner strands 96, and four such strands 95 are located in interstices between inner rope inner strands 96 and inner rope outer strands 94. Because of the arrangement of inner rope strands 96 and 94 and filler strands 96, wire rope 91 can be said to be of a filler wire configuration. It is to be understood that all strands of rope 91 could be lubricated, and that a thermoplastic or elastomer could extend to the periphery of inner rope 93 or to the periphery of outer strands 92, as desired. It is further understood that all strands of rope 91 are comprised of a plurality of individual wires.

Another imbodiment of the present invention is shown in FIG. 6. Wire rope 10 is comprised of an inner rope 102 and an outer rope 104. Outer rope 104 is comprised of fifteen individual strands 106, each of which is itself comprised of individual wires. Such outer strand 106 individual wires include outer wires 108, inner wires 112 and core wire 114. Inner rope 102 is comprised of eight outer layer strands 115, 116 and four inner layer strands 118. The outer layer of inner rope 102 comprises alternating four large diameter strands 115 and four smaller diameter strands 116. Each large diameter strand 115 is comprised of outer wires 128, alternating large and small diameter intermediate wires 130 and 132, respectively, and inner wires 134 with core wire 136. Each smaller diameter strand 116 is comprised of outer wires 139, inner wires 140 and core wire 142. The four inner layer strands 118 of inner rope 102 are each comprised of outer wires 144, inner wires 146 and core wire 148. Inner layer strands 118 form a coreless space 150 at the center of rope 100.

A thermoplastic or elastomer 152 extends from between inner layer strands 118 to the outer periphery of inner rope 102. Thermoplastic 152 acts to maintain a lubricant around inner rope strands 115, 116 and 118, and to keep such strands in prearranged relation to each other.

What is claimed is:

1. A wire rope comprising at least twelve outer strands, each of said outer strands having a plurality of component wires, and a plurality of inner rope strands, said inner rope strands being of parallel lay and comprising at least a central layer and an adjacent outer layer, said central layer of said inner rope strands forming a space at their axial center, each of said inner rope strands having a plurality of component wires, said separate outer strands of substantially uniform diameter and of a contrahelical parallel lay to said inner rope, said inner rope central layer comprising four separate strands of substantially uniform diameter, and said inner rope adjacent outer layer comprising four strands of a substantially uniform diameter and four strands of a larger diameter laid alternately.

2. The wire rope of claim 1, wherein the diameters of each of the outer strands and of the central layer of the inner rope strands are approximately equal.

3. The wire rope of claim 1, wherein the strand configuration of each of the outer strands and of each of the central layers of the inner rope strands is identical.

4. The wire rope of claim 1, wherein each outer strand has its component wires arranged in a seven outer wire, seven inner wire and single center wire arrangement.

5. The wire rope of claim 1, wherein said central layer of said inner rope has its component wires arranged in a seven outer wire, seven inner wire and single center wire arrangement.

6. The wire rope of claim 1, wherein said larger diameter strands comprising said inner rope adjacent outer layer are each arranged in a ten outer wire, ten inner adjacent wire, five inner wire and a single center wire arrangement.

7. The wire rope of claim 1, wherein a plastic fills the interstices between the inner rope strands and between the outer rope strands.

8. A wire rope comprising at least twelve outer strands, each of said outer strands having a plurality of component wires, and a plurality of inner rope strands, said inner rope strands being of parallel lay and comprising at least a central layer and an adjacent outer layer, said central layer of said inner rope strands forming a space at their axial center, each of said inner rope strands having a plurality of component wires, said outer strands of substantially uniform diameter and of a contrahelical parallel lay to said inner rope, said inner rope central layer comprises three separate strands of substantially uniform diameter, and said inner rope adjacent outer layer comprising nine strands of two different diameters laid such that each larger diameter strand separates two adjacent smaller diameter strands.

9. The wire rope of claim 8, wherein the diameters of each of the outer strands and of the central layer of the inner rope strands are approximately equal.

10. The wire rope of claim 8, wherein the strand configuration of each of the outer strands and of each of the central layer of the inner rope strands is identical.

11. The wire rope of claim 8, wherein a plastic fills the interstices between the inner rope strands and between the outer rope strands.

12. A wire rope comprising at least twelve outer strands, each of said outer strands having a plurality of component wires, and a plurality of inner rope strands, said inner rope strands being of parallel lay and comprising at least a central layer and an adjacent outer layer, said central layer of said inner rope strands forming a space at their axial center, each of said inner rope strands having a plurality of component wires, said outer strands of substantially uniform diameter and of a contrahelical parallel lay to said inner rope, said inner rope central layer comprising three separate strands of substantially uniform diameter, and said inner rope adjacent outer layer comprising six strands of two different diameters laid alternatively.

13. The wire rope of claim 12, wherein a plastic fills the interstices between the inner rope strands and between the outer rope strands.

14. A wire rope comprising at least twelve outer strands, each of said outer strands having a plurality of component wires, and a plurality of inner rope strands, said inner rope strands being of parallel lay and comprising at least a central layer and an adjacent outer layer, said central layer of said inner rope strands forming a space at their axial center, each of said inner rope strands having a plurality of component wires, said outer strands of substantially uniform diameter and of a contrahelical parallel lay to said inner rope, said inner rope central layer comprising four separate strands of a first substantially uniform diameter and four separate strands of a smaller substantially uniform diameter laid in the outer interstices of said first diameter central layer strands, and said inner rope adjacent outer layer comprising eight strands of substantially uniform diameter.

15. The wire rope of claim 14 wherein a plastic fills the interstices between the inner rope strands and between the outer rope strands.

* * * * *